US009138797B2

(12) United States Patent
Samek et al.

(10) Patent No.: US 9,138,797 B2
(45) Date of Patent: Sep. 22, 2015

(54) METHOD FOR PRODUCING A STRUCTURAL PART FROM AN IRON-MANGANESE STEEL SHEET

(71) Applicant: VOESTALPINE STAHL GMBH, Linz (AT)

(72) Inventors: Ludovic Samek, Linz (AT); Martin Peruzzi, Linz (AT); Enno Arenholz, Plesching (AT)

(73) Assignee: VOESTALPINE STAHL GMBH, Linz (AT)

( * ) Notice: Subject to any disclaimer, the term of this patent is extended or adjusted under 35 U.S.C. 154(b) by 0 days.

(21) Appl. No.: 13/674,243

(22) Filed: Nov. 12, 2012

(65) Prior Publication Data

US 2013/0125607 A1 May 23, 2013

Related U.S. Application Data

(63) Continuation of application No. PCT/EP2011/057280, filed on May 6, 2011.

(51) Int. Cl.

| | |
|---|---|
| ***B21D 22/20*** | (2006.01) |
| ***C21D 1/30*** | (2006.01) |
| ***B21D 22/02*** | (2006.01) |
| ***C21D 1/673*** | (2006.01) |
| ***C21D 6/00*** | (2006.01) |
| ***C21D 8/02*** | (2006.01) |
| ***C21D 9/00*** | (2006.01) |
| ***B21D 31/00*** | (2006.01) |

(52) U.S. Cl.

CPC ..... *B21D 22/208* (2013.01); *B21D 22/02* (2013.01); *B21D 31/00* (2013.01); *C21D 1/30* (2013.01); *C21D 1/673* (2013.01); *C21D 6/005* (2013.01); *C21D 8/0205* (2013.01); *C21D 9/0068* (2013.01)

(58) Field of Classification Search

CPC ..... B21D 22/208; C12D 1/30; C12D 1/673; C12D 8/0205; C12D 6/005; C12D 9/0068

USPC ..... 72/347, 348, 364, 702; 148/649–651, 148/619

See application file for complete search history.

(56) References Cited

U.S. PATENT DOCUMENTS

| | | | | |
|---|---|---|---|---|
| 6,463,779 | B1 * | 10/2002 | Terziakin | 72/342.96 |
| 6,564,604 | B2 * | 5/2003 | Kefferstein et al. | 72/47 |
| 6,941,784 | B2 * | 9/2005 | Koyama et al. | 72/31.1 |

(Continued)

FOREIGN PATENT DOCUMENTS

| | | | |
|---|---|---|---|
| DE | 102008050315 | A1 * | 5/2009 |
| JP | 2005047001 | A | 2/2005 |
| KR | 902857 | B1 * | 6/2009 |

OTHER PUBLICATIONS

Chinese Office Action cited in Chinese Application No. 201180028966.0 dated Mar. 28, 2014, 7 pgs.

(Continued)

*Primary Examiner* — Debra Sullivan

(74) *Attorney, Agent, or Firm* — Cooper Legal Group, LLC

(57) ABSTRACT

In a method for producing a structural part from an iron-manganese-stell sheet (1), a sheet-metal workpiece (2) is cold-formed in a forming die (3). The formed sheet-metal workpiece is heated to a temperature between 500° C. and 700° C. (4) and calibrated in a calibrating die (5).

19 Claims, 1 Drawing Sheet

(56) References Cited

U.S. PATENT DOCUMENTS

Figure 1:
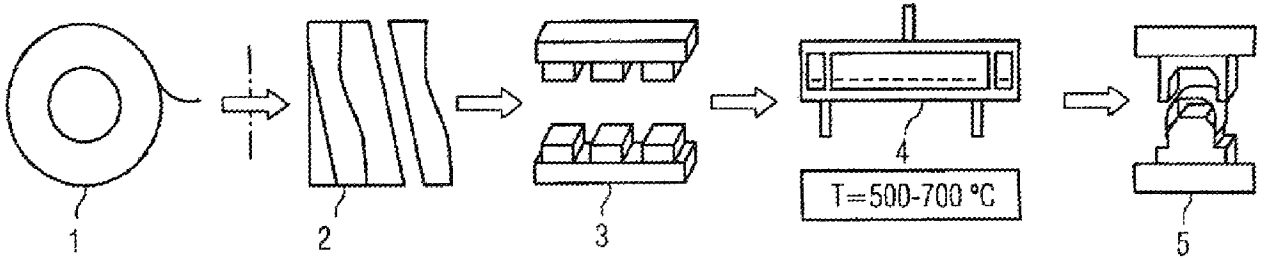

| | | | | |
|---|---|---|---|---|
| 8,181,498 | B2 * | 5/2012 | Tocco | 72/101 |
| 2010/0269962 | A1 | 10/2010 | Im et al. | |

OTHER PUBLICATIONS

"Latest Progress in Development and Application of Advanced High Strength Steels for Automobiles", Jiang Hai-Tao, Tang Di and Mi Zhen-Li, Aug. 31, 2007, Journal of Iron and Steel Research Aug. 2007, 1 pg.

"Microstructures, mechanical properties and strengthening mechanisms of a 23/8% Mn TRIP/TWIP steel", Zhang Shu-Juan, Ding Hua, Ding Hao, Zeng Jian-Min and Tang Zheng-You, Sep. 30, 2009, Journal of Materials and Metallurgy Mar. 2009, 1 pg.

Korean Office Action cited in Korean Application No. 2012-7032350 dated Apr. 30, 2015, 9 pgs.

* cited by examiner

METHOD FOR PRODUCING A STRUCTURAL PART FROM AN IRON-MANGANESE STEEL SHEET

The invention relates to a method for producing a structural part from an iron-manganese steel sheet.

Iron-manganese steels are lightweight structural steels which can have a high strength and at the same time a high ductility. This makes iron-manganese steels a material having great potential in vehicle construction. A high material strength makes it possible to reduce the body weight, as a result of which the fuel consumption can be lowered. A high ductility and stability of the steels is important both for the production of the body parts by deep-drawing processes and for the crash behaviour thereof. By way of example, structural and/or safety parts such as, for example, door impact bars, A-pillars and B-pillars, bumpers or longitudinal and transverse members have to realize complex structural part geometries, and at the same time have to be able to achieve the weight objectives and safety requirements.

It is already known to produce structural body parts from iron-manganese steel sheet by cold forming. However, as a result of cold work-hardening in formed regions, the cold forming leads to a reduction in the deformability and thus to a reduction in the energy absorption potential in the event of loading (crash). Such inhomogeneous mechanical structural part properties brought about by the cold work-hardening can have the effect that the structural part does not achieve the safety requirements. Further disadvantages of the cold forming technique are that it increases the risk of delayed cracking as a result of hydrogen embrittlement, the formed part displays a considerable spring back effect and cold-formed structural parts have inadequate numerical simulation properties for the structural part behaviour in the event of loading.

Hot forming is a known alternative to the cold forming method. Conventional hot forming processes are carried out at high temperatures of approximately 900° C. or thereabove. Hot forming reduces both the spring back effect of the formed structural part and also the cold work-hardening in formed regions. With the hot forming technique, it is thus possible to produce complex deep-drawn parts without a significant spring back effect under tension. Disadvantages of hot forming are, however, the high process temperatures and the material-dependent reduction in the strength of the structural part, brought about by the hot forming, after the cooling process.

In order to avoid the reduction in strength, hot forming is often combined with the hardening technique. This involves the known possibility of increasing the strength of steel materials by martensite formation. During hardening, heating of the structural part to the so-called hardening temperature above Ac3 produces an austenitic microstructure, which is then transformed completely into martensite by rapid cooling. A condition for the complete martensite transformation in this respect is that a critical cooling rate is exceeded. This requires cooled pressing dies which, as a result of contact between the hot workpiece surface and the cold die surface, make sufficiently rapid cooling of the workpiece possible.

An object on which the invention is based can be considered that of providing a method which makes it possible to produce formed structural parts from iron-manganese steel sheet having good mechanical properties in a cost-effective manner. In particular, the method should make it possible to produce formed sheet metal workpieces having a complex structural part geometry and favourable material properties even in formed structural part regions.

The object on which the invention is based is achieved by the features of Claim 1. Advantageous configurations and developments are specified in the dependent claims.

The invention provides a method for producing a structural part from an iron-manganese steel sheet, in which method a sheet metal workpiece is cold-formed in a forming die, the formed sheet metal workpiece is heated to a temperature of between 500° C. and 700° C., and the heated sheet metal workpiece is calibrated in a calibrating die. The calibration of the formed sheet metal workpiece at the elevated temperatures indicated can have the effect that cold work-hardening which has arisen during the cold forming in the formed regions is reduced again. In particular, this can achieve homogenization of the mechanical properties over the entire structural part. Further advantages of the method according to the invention consist in the fact that the calibration of the heated structural part considerably reduces both the risk of delayed cracking as a result of hydrogen embrittlement and also the spring back effect of the structural part after it has been removed from the calibrating die.

It is pointed out that, at the indicated temperatures, the austenitization temperature Ac3 is not exceeded, i.e. that no transformation of the workpiece microstructure to a completely austenitic microstructure occurs during heating.

The degree to which the cold work-hardening in the formed structural part regions is reduced can be controlled by the selection of the temperature. At high temperatures, the strength of the formed regions can even be lowered to below the strength in regions which have not been formed or have been formed to a lesser extent. In order to avoid an excessive reduction of the cold work-hardening, a temperature of between 600° C. and 680° C. may be advantageous. To heat the formed sheet metal workpiece to the elevated temperature required for calibration, the formed sheet metal workpiece can be heated in a furnace and, after the heating, can be inserted into the calibrating die. It is also conceivable for the sheet metal workpiece to be heated directly in the calibrating die. In both cases, the initial temperature for the calibration can likewise lie in the indicated range of between 500° C. and 700° C. During the calibration, the formed sheet metal workpiece is then cooled in a held or fixed state.

The residence time of the sheet metal workpiece in the furnace can be chosen so as to ensure homogeneous through-heating of the sheet metal workpiece, in which case it is to be taken into consideration that an increase in the duration of the heating process is typically to be expected with an increasing thickness of the sheet metal workpiece.

The sheet metal workpiece is rapidly cooled in the held state in the calibrating die. Since no microstructure transformation from the austenite microstructure to the martensite microstructure, as is necessary for the so-called press hardening, has to be effected during the cooling, the critical minimum cooling rate known from press hardening does not have to be observed, i.e. the cooling rate in the calibrating die can be determined according to other aspects (for example cycle times, operating costs, tool costs, etc.).

The heating temperature of the formed sheet metal workpiece is important for reducing the cold work-hardening in formed portions of the sheet metal workpiece. In one exemplary embodiment, it may be set such that the cold work-hardening in formed portions of the (formed) sheet metal workpiece is reduced by at least 70%, in particular at least 80%, by the calibration.

According to a further exemplary embodiment, the heating temperature of the sheet metal workpiece can be set such that the calibrated sheet metal workpiece has a maximum tensile strength fluctuation range of 20%, in particular 10%, over its entire geometry. In other words, it is possible to achieve extensive homogenization of the mechanical properties of the structural part in relation to the tensile strength.

Figure 2:
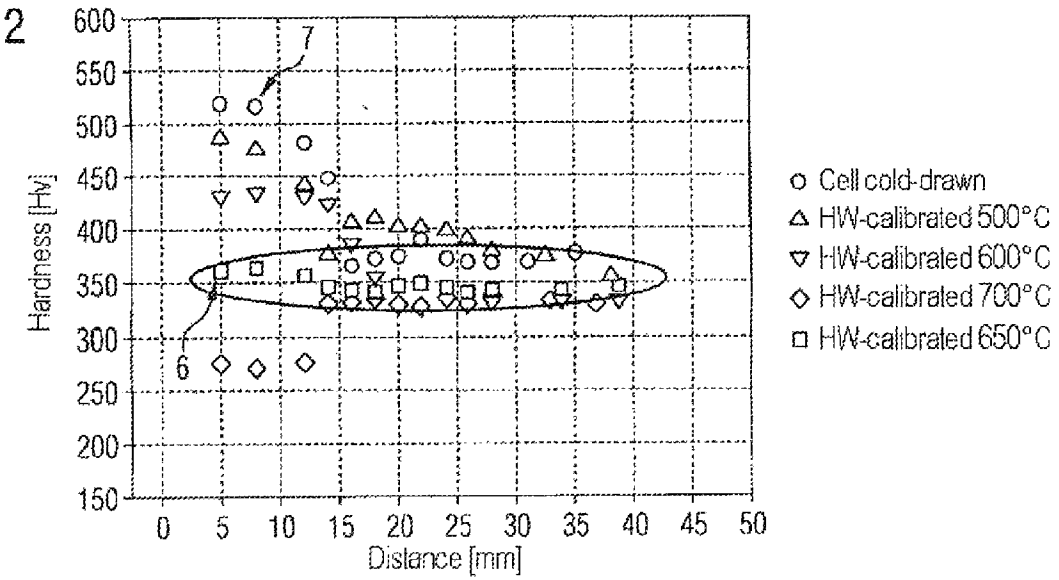

The invention will be explained in more detail by way of example hereinbelow on the basis of the description, with reference to the drawings, in which:

FIG. 1 shows a schematic illustration of a sequence of method steps according to one exemplary embodiment of the invention; and FIG. 2 shows a graph, in which the hardness of a formed structural part is plotted against a distance from the forming site.

In the text which follows, exemplary embodiments of a method for producing a structural part from iron-manganese steel sheet are described. The structural part may be, for example, a structural body part for vehicle construction. The structural body part may have a complex structural part geometry. This may involve a structural and/or safety part which may have to satisfy particular safety requirements in the event of loading (crash). By way of example, the structural part may be an A-pillar or B-pillar, a side impact protective bar in doors, a sill, a frame part, a bumper, a transverse member for the floor and roof or a front or rear longitudinal member.

The structural part consists of an iron-manganese (FeMn) steel. FeMn structural parts are known in vehicle construction and can have a manganese content of approximately 12 to 35% by weight. Use can be made, for example, of TWIP, TRIP/TWIP and TRIPLEX steels and also mixed forms of these steels. TWIP (TWinning Induced Plasticity) steels are austenite steels. They are distinguished by a high manganese content (e.g. above 25%) and relatively high alloying additions of aluminum and silicon. During plastic cold forming, intensive twinning which solidifies the steel takes place. TWIP steels have a high elongation at break. They are therefore particularly suitable for producing structural or safety parts in regions of the body pertinent to accidents.

TRIP/TWIP steels are combinations of TWIP and TRIP (TRansformation Induced Plasticity) steels. TRIP steels consist essentially of a plurality of phases of iron-carbon alloys, specifically ferrite, bainite and carbon-rich residual austenite. The TRIP effect is based on the deformation-induced transformation of the residual austenite into the high-strength martensitic phase (α-martensite). In the case of TRIP/TWIP steels, a double TRIP effect occurs, since the austenitic microstructure is transformed firstly into the hexagonal and then into the body-centred cubic martensite. On account of the two martensitic transformations, TRIP/TWIP steels have a double elongation reserve.

TRIPLEX steels consist of a multiphase microstructure of α-ferrite and γ-austenite solid solutions with a martensitic s-phase and/or K-phase. They have good forming properties.

Furthermore, combinations of said steels can be used in exemplary embodiments of the invention. The exemplary list of the aforementioned steels is not conclusive; other FeMn steels can likewise be used for the invention.

FIG. 1 schematically shows an exemplary embodiment of a method according to the invention, in which optional method steps are also shown. The starting point for the method sequence is a coil 1 of strip steel, as is produced for example in a steelworks and delivered to a client (e.g. vehicle manufacturer or supplier). The FeMn strip steel may be, for example, a cold-rolled and annealed steel. It is also possible, however, to use a hot-rolled steel. The process for producing the FeMn strip steel in the steelworks should be configured such as to ensure good cold forming properties of the steel.

The strip steel is then cut into FeMn boards 2, for example at the vehicle manufacturer or supplier. The cutting is effected in a cutting station.

One or more boards 2 are then inserted into a cold forming die 3 and cold-formed. The temperatures in the cold forming die can lie in the conventional range, e.g. at approximately 70° C. to 80° C. Furnaces are not used for realizing these temperatures. The residence time of the workpiece in the cold forming die 3 typically does not have a considerable influence on the workpiece properties.

During the cold forming, locally different strengths are achieved, depending on the structural part geometry. The greater the local degree of forming, the higher the corresponding strength value. This effect is also referred to as cold work-hardening. Instances of severe cold work-hardening of up to approximately 1800 MPa can occur. The tensile strength of the starting material (board 2) can be e.g. approximately $R_m \approx 1100$ MPa, the yield strength can be e.g. $R_{p0.2} \approx 600$ MPa and the elongation at break A of the starting material can be e.g. 40% or more (A ≥40%). During cold forming, it is possible to take the spring back effect into account and to form the workpiece beyond the final geometrical dimension thereof. This is not absolutely necessary, however, on account of the subsequent process steps. The cold forming die 3 can be realized in the form of a deep-drawing press.

Furthermore, it is possible for the workpiece to simultaneously be trimmed in the cold forming die 3. This trimming may involve final trimming of the structural part. Furthermore, it is possible to carry out punching operations which may be required or the production of a hole pattern in the cold forming die 3. That is to say, after the cold forming step, a structural part having e.g. a completely finished structural part form in terms of material-removing processes can already be present.

It is also possible for material-removing processes (trimming, hole pattern production, etc.) to be carried out in a cutting line (not shown), which is arranged outside and downstream of the cold forming die 3 (which is located in the so-called press line). In this case, too, the end structural part in terms of material-removing processes may already be present after the trimming or the hole pattern production.

The cold-formed and possibly trimmed workpiece is then fed to a furnace 4, where it is heated to a temperature of between 500° C. and 700° C. The heating should be carried out until the structural part is brought homogeneously to a uniform temperature (T=500° C.-700° C.). When the uniform temperature has been reached, it can be held at this temperature for a certain time. By way of example, the residence time in the furnace can be 10 min, where 5 min are used for reaching the homogeneous temperature distribution and the further 5 min are used for keeping the structural part at said homogeneous temperature. Since no microstructure transformation decisive for the properties of the structural part is associated with the increase in temperature, however, it should also be possible for the heating step to be carried out without a holding time. It is possible for the furnace temperature to be considerably higher than the desired target temperature T=500° C.-700° C. of the workpiece and for the workpiece temperature to be controlled over the residence time in the furnace 4.

The furnace 4 used may be a radiation furnace, or it is possible to provide furnaces which feed energy to the workpiece in a different way. By way of example, it is possible to use convective heating, inductive heating or infrared heating and also combinations of said mechanisms.

The formed workpiece heated to the target temperature of between 500° C. and 700° C. is then removed from the furnace 4 and inserted into a calibrating die 5, where it is fixed in the desired shape and cooled. The temperature of the workpiece at the start of the calibrating process can also be lower than the temperature of the workpiece when it is removed from the furnace; in particular, it can be between 400° C. and 700° C. The calibrating die 5 may be, for example, a calibrating press. The calibration ensures the dimensional stability of the workpiece. The surface geometry of the pressing faces of the die corresponds to the final shape of the workpiece or has a very near-net shape, since the spring back effect is reduced considerably by the calibration in the calibrating die. By holding the workpiece in the calibrating die in the desired shape, the workpiece is thus given the final shape.

The workpiece is cooled in the calibrating die 5 with the workpiece in a fixed state, i.e. with the workpiece surfaces bearing against the die surfaces. The heat is dissipated via the die. The cooling rate can be, for example, approximately 30° C./s, but ought to be noncritical, since, unlike in the case of press hardening, no critical cooling rate has to be exceeded. By way of example, the cooling rate can be less than 50° C./s, which is achievable without a relatively high outlay on tools and in many cases makes sufficiently short cycle times possible. Higher cooling rates, for example in the range of 50° C./s to 150° C./s, are likewise possible. The calibrating die 5 may have a cooling device (e.g. water cooling). By virtue of the heating and the subsequent "held" cooling of the workpiece with a fixed workpiece geometry, the cold work-hardening obtained in the regions of high elongation is reduced, i.e. lowered, equalized or possibly even overcompensated, as will be explained further below in conjunction with FIG. 2.

The temperature of the heated workpiece at the start of the calibration can likewise be in the indicated range of T=500° C. to 700° C. or only slightly therebelow. This can be ensured by virtue of the fact that the transport path between the furnace 4 and the calibrating die 5 is short and/or that the heated workpiece is heated or kept warm on the transport path between the furnace 4 and the calibrating die 5, e.g. by heat radiation. Another possibility consists in realizing the furnace 4 and the calibrating die 5 in the same press station, i.e. in providing a calibrating die 5 which is coupled to a furnace.

The exemplary embodiments of the invention which are described with reference to FIG. 1 can be modified and developed in various ways. By way of example, coated FeMn steels can be used for the method. The sheet metal workpiece can be coated with an organic and/or inorganic or metallic coating, in particular an alloy based on zinc or aluminum. The coating can be performed before the cold forming or at another point in time, e.g. after the calibration.

Cathodic corrosion protection is provided, for example, by galvanizing. The coating can be performed electrolytically or by a hot dipping method before the cold forming step 3 (e.g. already on the coil 1 at the steel manufacturer) or else after the cold forming step 3 and before heating in the furnace 4. In the case of a Zn coating, the heat treatment before or during the calibration forms a solid solution layer between the FeMn steel and the Zn coating which ensures good adhesion of the Zn layer on the structural part. It is also possible to perform the coating (e.g. galvanizing) only on the finished structural part, i.e. after the calibration in the calibrating die 5.

FIG. 2 relates to further exemplary embodiments of the method explained by way of example with reference to FIG. 1, and illustrates the reduction in the cold work-hardening depending on the workpiece temperature reached during heating. FIG. 2 shows the Vickers hardness Hv depending on the distance from the forming site. Use was made of a board 2 which was cut from a cold-rolled, annealed FeMn strip steel. The board 2 had a tensile strength $R_m \approx 1100$ MPa, which corresponded to the tensile strength of the strip steel. The elongation at break was A≈60%. A plurality of identical cells having a diameter D=50 mm were deep-drawn from a plurality of boards 2 by means of a cold forming die 3. The cells were then heated to the different temperatures T=500° C., 600° C., 650° C. and 700° C. in a furnace 4. The residence time in the furnace 4 in each case was 10 min, and therefore complete and homogeneous through-heating of the cells was ensured. Immediately thereafter, and at substantially the same temperature T, the hot cells were fixed in the final shape in a calibrating die 5, where they were cooled. The cooling rate in this example was approximately 30° C./s.

The Vickers hardness Hv can be used as a measure for the tensile strength $R_m$, the conversion factor being approximately 3.1, i.e. a Vickers hardness Hv=350 corresponds approximately to a tensile strength $R_m \approx 1100$ MPa of the starting material, see reference numeral 6. For the cold-drawn, non-heated cell, FIG. 2 shows a cold work-hardening in the range of $R_m$=1600 MPa (corresponds to Hv=520), see reference numeral 7, which leads to greatly inhomogeneous mechanical properties in the structural part. In addition, the risk of delayed cracking as a result of hydrogen embrittlement is increased, since this arises particularly where a high cold work-hardening gradient is observed on cold forming.

The hot calibration according to the invention leads to a reduction in the cold work-hardening in the cells. At a temperature T=500° C., the tensile strength in the vicinity of the forming site is still $R_m \approx 1490$ MPa (Hv=480), at T=600° C. the maximum cold work-hardening has already been reduced to $R_m \approx 1330$ MPa (Hv=430), T=650° C. leads virtually to an equalization of the mechanical properties ($R_m \approx 1120$ MPa, corresponding to Hv=360) in formed and non-formed portions of the structural part, and at T=700° C. there is an overcompensation, i.e. the workpiece strength in the portion close to where forming is performed is $R_m \approx 870$ MPa (Hv=280), and is therefore significantly below the tensile strength in portions of the workpiece (cell) which have not been formed or have been formed only to a minor extent.

It can be seen from FIG. 2 that the cold work-hardening in the region of a structural part close to where forming is performed can be influenced in a targeted manner and reduced as desired to a specific value by choosing a suitable temperature T for the hot calibration. By way of example, it is possible to achieve homogeneous mechanical properties with respect to the tensile strength having a fluctuation range of less than 20% or even 10% in relation to formed and non-formed portions of the structural part. It is also possible to reduce the cold work-hardening by 70% or 80%, for example. FIG. 2 shows that the heat treatment and the hot calibration influence and reduce only the increased strength values brought about by cold work-hardening, whereas the mechanical properties in the other portions of the workpiece, which have not been subjected to forming, barely change. In other words, it is possible for a structural part having a complex structural part geometry to have homogeneous mechanical properties over its entire extent or for it to obtain increased or reduced strengths in a targeted manner compared to non-formed portions at forming sites.

The invention claimed is:

1. A method, comprising:

cold-forming a sheet metal workpiece by deep-drawling the sheet metal workpiece beyond its final geometrical shape in a forming die to yield a formed sheet metal workpiece;

thereafter, heating the formed sheet metal workpiece to a temperature of between 500° C. and 700° C. in a calibrating die to yield a heated sheet metal workpiece; and calibrating the heated sheet metal workpiece in a calibrating die by holding the heated sheet metal workpiece in a fixed state and cooling the heated sheet metal workpiece to yield a cooled sheet metal workpiece.

2. The method according to claim 1, wherein the temperature is above 600° C. and below 680° C.

3. The method according to claim 1, wherein a residence time in the calibrating die is chosen so as to ensure substantially homogeneous through-heating of the formed sheet metal workpiece.

4. The method according to claim 1, wherein the sheet metal workpiece is at least one of the TWIP steel, TRIP/TWIP steel or TRIPLEX steel.

5. The method according to claim 1, wherein the sheet metal workpiece comprises manganese content of the sheet metal workpiece is between 12% and 35% by weight.

6. The method according to claim 1, wherein the temperature is set such that cold work-hardening in formed portions of the formed sheet metal workpiece is reduced by at least 70%, by the calibrating.

7. The method according to claim 1, wherein the temperature is set such that the cooled sheet metal workpiece has a maximum tensile strength fluctuation range of 20%, over its entire geometry.

8. The method according to claim 1, further comprising:

coating the sheet metal workpiece with an organic coating, an inorganic coating, or metallic before the cold-forming.

9. The method according to claim 1, further comprising:

coating the sheet metal workpiece with at least one of an organic coating inorganic coating, or metallic coating after the calibration.

10. The method according to claim 1, wherein the sheet metal workpiece comprises an iron-manganese steel sheet.

11. A method, comprising:

cold-forming a sheet metal workpiece comprising manganese by deep-drawing the sheet metal workpiece beyond its final geometrical shape in a forming die to yield a formed sheet metal workpiece, wherein the manganese content of the sheet metal workpiece is between 12% and 35% by weight;

thereafter, heating the formed sheet metal workpiece to a temperature above 600° C. and below 700° C. to yield a heated sheet metal workpiece; and calibrating the heated sheet metal workpiece in a calibrating die by holding the heated sheet metal workpiece in a fixed state and cooling the heated sheet metal workpiece to yield a cooled sheet metal workpiece.

12. The method according to claim 11, wherein the heating comprises heating the formed sheet metal workpiece in a furnace and the method comprises inserting the heated sheet metal workpiece into the calibrating die.

13. The method according to claim 12, wherein a residence time of the formed sheet metal workpiece in the furnace is chosen so as to ensure substantially homogeneous through-heating of the formed sheet metal workpiece.

14. The method according to claim 11, wherein the sheet metal workpiece is at least one of TWIP steel, TRIP/TWIP steel or TRIPLEX steel.

15. The method according to claim 11, wherein the temperature is set such that cold work-hardening in formed portions of the formed sheet metal workpiece is reduced by at least 70% by the calibrating.

16. The method according to claim 11, wherein the temperature is set such that the cooled sheet metal workpiece has a maximum tensile strength fluctuation range of 20% over its entire geometry.

17. The method according to claim 11, wherein the heating comprises heating the formed sheet metal workpiece in the calibrating die.

18. The method according to claim 17, wherein a residence time in the calibrating die is chosen so as to ensure substantially homogeneous through-heating of the formed sheet metal workpiece.

19. The method according to claim 11, wherein the sheet metal workpiece comprises an iron-manganese steel sheet.

* * * * *